US005454323A

United States Patent [19]

Conil

[11] Patent Number: 5,454,323

[45] Date of Patent: Oct. 3, 1995

[54] COMBUSTIBLE CONTAINER ELEMENTS FOR ARTILLERY AMMUNITION, METHOD OF MANUFACTURE AND USE OF SUCH ELEMENTS

[75] Inventor: Bernard Conil, Bergerac, France

[73] Assignee: Societe Nationale des Poudres et Explosifs, Paris Cedex, France

[21] Appl. No.: 314,157

[22] Filed: Sep. 28, 1994

[30] Foreign Application Priority Data

Oct. 5, 1993 [FR] France ..... 93 11829

[51] Int. Cl.[6] ..... F42B 5/18

[52] U.S. Cl. ..... 102/282; 102/431; 102/700

[58] Field of Search ..... 102/431, 432, 102/433, 700, 282; 86/10

[56] References Cited

U.S. PATENT DOCUMENTS

| | | | |
|---|---|---|---|
| 3,320,886 | 5/1967 | De Luca . | |
| 3,474,702 | 10/1969 | Remaly et al. . | |
| 3,550,532 | 12/1970 | Zimmerman . | |
| 4,864,932 | 9/1989 | Reinelt et al. . | |
| 5,052,304 | 10/1991 | Rahnenfuhrer et al. . | |
| 5,282,423 | 2/1994 | Sikorski et al. | 102/431 |

FOREIGN PATENT DOCUMENTS

| | | | |
|---|---|---|---|
| 0475207 | 3/1992 | European Pat. Off. . | |
| 5105572 | 4/1993 | Japan | 102/431 |
| 5118792 | 5/1993 | Japan | 102/431 |
| 5118793 | 5/1993 | Japan | 102/431 |

*Primary Examiner*—Charles T. Jordan
*Assistant Examiner*—Theresa M. Wesson
*Attorney, Agent, or Firm*—Bucknam and Archer

[57] ABSTRACT

The present invention relates to combustible container elements (24) for artillery ammunition.

The said elements, obtained by felting, compacting and stoving, have a plane axisymmetric part (2,7), an outer wall (5,10) and an inner neck (4,9) which are integral. Two complementary elements thus make it possible to obtain combustible containers which are easy to charge with loose powder (25) and which present no problem in positioning the central channel since the latter consists of the inner necks (4,9). A complementary combustible ignition tube (26) made of agglomerated powder is advantageously positioned inside the central channel thus defined.

The invention also relates to a method of obtaining these elements by using a specially adapted felting mould.

3 Claims, 6 Drawing Sheets

COMBUSTIBLE CONTAINER ELEMENTS FOR ARTILLERY AMMUNITION, METHOD OF MANUFACTURE AND USE OF SUCH ELEMENTS

FIELD OF THE INVENTION

The present invention relates to the field of artillery ammunition. More precisely, the invention relates to combustible container elements making it possible easily to construct entirely combustible modular charges for such ammunition.

The invention also relates to a method of obtaining such elements by a felting technique.

BACKGROUND OF THE INVENTION

For artillery ammunition with medium and large calibre, it is increasingly being sought to obtain entirely combustible propellant charges which make it possible to overcome the constraints linked with the use of non-combustible metal cases. Furthermore, since the propellant charge is to be alterable as a function of the parameters of the shot envisaged, a particularly advantageous solution is that proposed by modular charges.

Such charges consist of identical modules composed of a cylindrical combustible housing having a central channel and filled with a propellant powder charge. As a function of the parameters of the shot, the user of the weapon determines the number of modules to use and, possibly, their nature.

Although the solution of entirely combustible modular charges is of very great theoretical interest, it is in practice of limited use because of the complexity hitherto involved in the practical production of such modular charges.

A first embodiment was proposed by Patent Application FR-A-2,497,335. According to this application, the combustible housing comprises a body and a bottom, a cover and a central tube. These various elements are made from combustible elements in plate form by thermoforming and are bonded to one another. A first drawback presented by this solution resides in the correct positioning of the various elements constituting the housing and, in particular, in the correct positioning of the central tube intended for transmitting the ignition from one housing to another. A second drawback resides in the use of combustible materials which are to undergo a thermoforming operation.

In order to overcome this second drawback, the person skilled in the art then sought to use combustible housings obtained by a felting technique.

Another solution, described in U.S. Pat. No. 4,922,823, thus consists in making the housing by assembling and bonding to each other two hollow combustible cylindrical elements which are each closed at one of their ends by a plane face having a central orifice bordered by an internal neck with a height less than the height of the said element. At the moment of assembling the two elements, it is necessary to fit the central tube which consists of agglomerated propellant powder and which bears on the two central necks. A first drawback of such a solution is the practical difficulty of carrying out such an assembly. A second drawback is the difficulty of completely filling such a housing with the loose propellant powder.

A solution, which is similar to the former, was proposed by Patent Application EP-A-0,475,207.

This solution also consists in producing the combustible housing from two hollow combustible cylindrical elements which are each closed at one of their ends by a plane face having a central orifice and are assembled and bonded to one another. The central channel is a hollow tube of agglomerated propellant powder bearing on the inside of the two plane faces and the propellant charge is a hollow cylindrical block of agglomerated propellant powder. This solution has the drawback of being limited to propellant charges of agglomerated powder and, moreover, has the additional problem of correct positioning of the central tube.

Solutions currently known to Applicants Company therefore all have the major drawback of resorting to a modular charge with constituent elements which do not incorporate the central tube intended to transmit the ignition, in order to constitute the cylindrical housing. These solutions therefore all require fitting the central tube during assembly of the housing, which fitting is difficult for batch production. In addition, the housings thus obtained are often difficult to completely charge with the loose powder. Finally, it should be noted that the more separate parts a housing contains, the greater is its cost price.

SUMMARY OF THE INVENTION

The object of the present invention is specifically to provide modular combustible containers whose housings do not have the abovementioned drawbacks.

The invention therefore relates to combustible container elements for artillery ammunition, obtained by felting on a liquid-permeable mould of an aqueous suspension principally consisting of nitrocellulose fibres, cellulose fibres and of a resin, so as to obtain a blank of the said element which is subsequently compacted and stoved, characterized, on the one hand, in that the said elements have at least one substantially plane axisymmetric part having a central orifice bordered by a hollow central neck and, on the other hand, in that the felting of the said blank is carried out in a single operation.

According to a first preferred embodiment of the invention, the said central orifice is a circular orifice and the said central neck is a cylindrical neck.

According to a second preferred embodiment of the invention, the said plane axisymmetric part is bordered by a cylindrical outer wall located on the same side of the said plane part as the said central neck.

According to a third preferred embodiment of the invention, the said outer wall has a height substantially equal to the height of the said central neck.

The invention also relates to the use of elements according to the invention in a method of production of combustible containers charged with powder for artillery ammunition, characterized in that:

1) two complementary combustible container elements are manufactured by felting, compacting and stoving, 2) one of the said elements is filled with a propellant powder, and 3) the element thus filled is solidly attached to the second element so as to constitute a combustible container filled with powder and having a central channel.

Within the scope of the present invention, two combustible container elements will be said to be complementary when, by assembling them with each other, they define a cylindrical housing which is closed at each of its ends by a plane face having a central orifice, the two central orifices being connected with continuity by a central channel consisting of the necks of the said elements. As will be explained hereinbelow, the two complementary elements are, most often, not identical.

In a preferred embodiment of the invention, a complementary ignition tube is introduced into the said central channel constituted in this manner. Preferably, this ignition tube is obtained by agglomerating grains of propellant powder coated with a binder based on polyvinyl nitrate.

Finally, the invention also relates to a method of manufacture by felting of a blank of elements according to the invention, characterized in that a mould is immersed in an aqueous suspension principally consisting of nitrocellulose fibres, cellulose fibres and of a resin, which mould has an axisymmetric cavity consisting of an outer casing, of a bottom whose surface is plane and having a central column, at least the said bottom and the said column being liquid-permeable and being held at a distance from the inner walls of the mould so as to form an empty space, and in that suction is exerted inside the said empty space.

According to a preferred embodiment of the invention, the said outer casing is at least partially liquid-permeable and defines an empty space in which a vacuum can be made.

The invention thus makes it possible, starting with only two elements obtained by felting, to construct a complete combustible-module housing for artillery charge in which the central channel incorporated with the said elements, requires no particular positioning and no bonding operation.

Furthermore, when one of the two elements constitutes the cover of the housing and the other element constitutes the body of the housing, incorporating substantially all of the central channel, complete filling of the housing with the propellant powder in grain form is a very simple operation. Of course, the housing may also be filled with a charge in block or stick form.

BRIEF DESCRIPTION OF THE DRAWINGS

The invention is now described in detail with reference to FIGS. 1 to 10.

The invention relates to combustible container elements for artillery ammunition. FIGS. 2 and 4 represent such an element 1 according to the invention.

Figure 2:
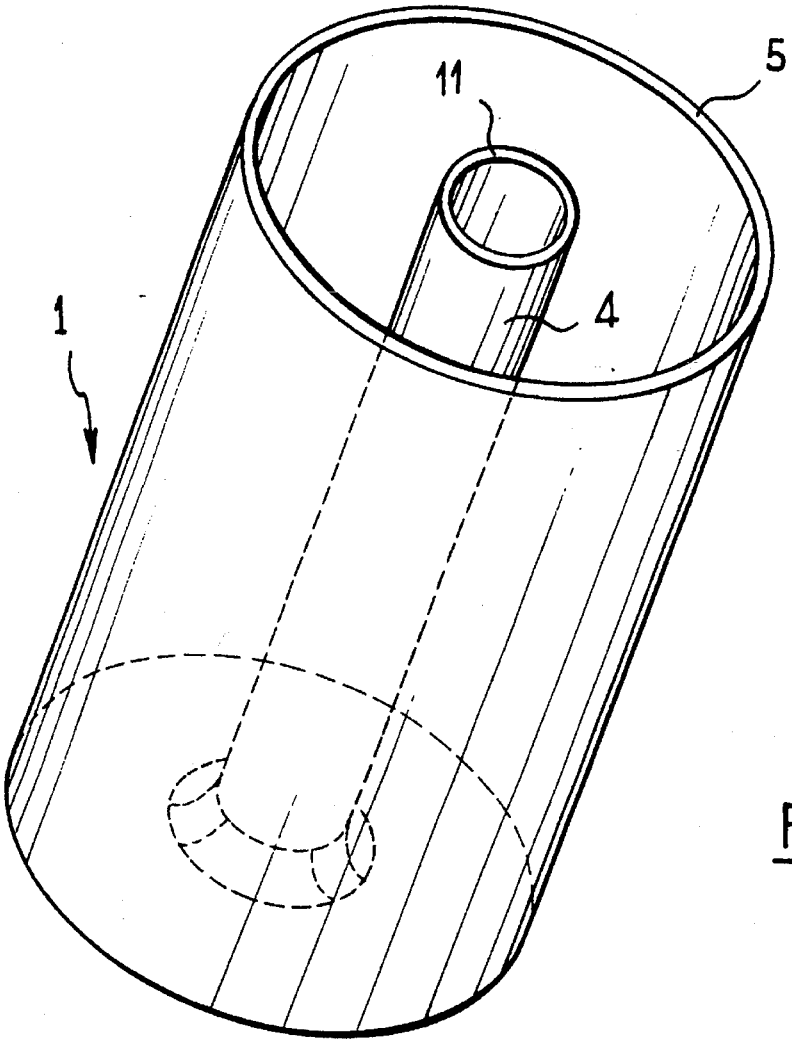
FIGS. 2 and 3 represent, seen in perspective, two complementary elements according to the invention, FIG. 2 representing a housing body and FIG. 3 a housing cover.
Figure 4:
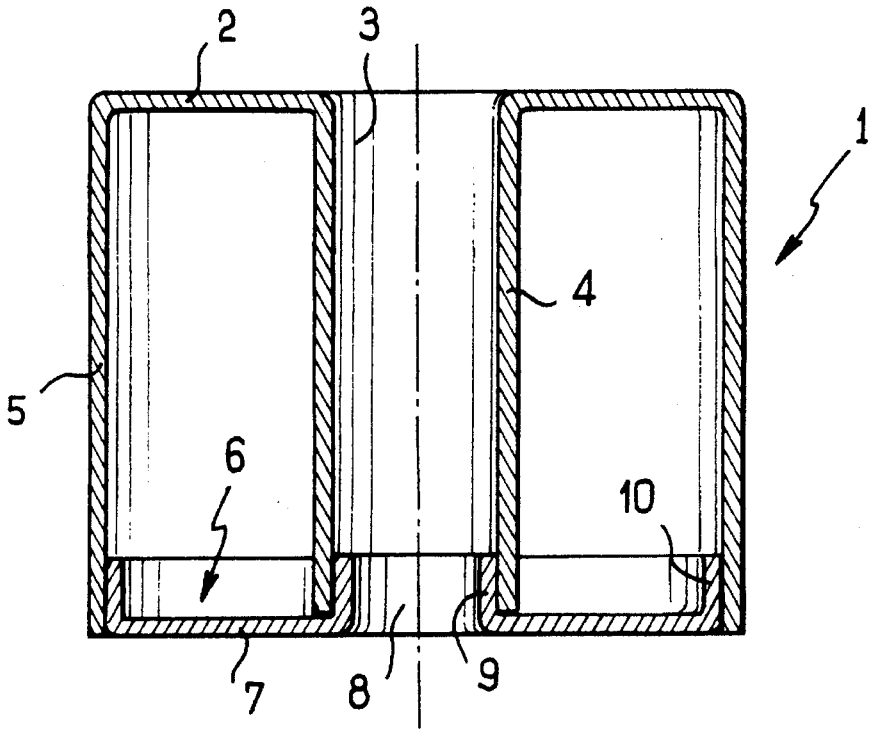
FIG. 4 represents, seen in section, the configuration of two complementary elements constituting a housing and represented in FIGS. 2 and 3.

Characteristically, such an element 1 has at least one plane axisymmetric part 2 having a central orifice 3 bordered by a hollow central neck 4. According to a first preferred embodiment of the invention, the said central orifice 3 is a circular orifice and the said hollow central neck 4 is a cylindrical neck. According to a second preferred embodiment of the invention, the said plane axisymmetric part 2 is bordered over its entire periphery by a cylindrical outer wall 5 located on the same side of the said plane part 2 as the said central neck 4. Preferably, as represented in FIGS. 2 and 4, the said outer wall 5 has a height substantially equal to the height of the said central neck 4. Such an element 1 is intended to constitute the body of a modular combustible container, the outer wall 5 constituting the outer wall of the housing of the container, the plane part 2 constituting the bottom of the housing and the hollow neck 4 constituting the ignition tube, the wall 5, the plane part 2 and the hollow neck 4 being integral.

Figure 3:
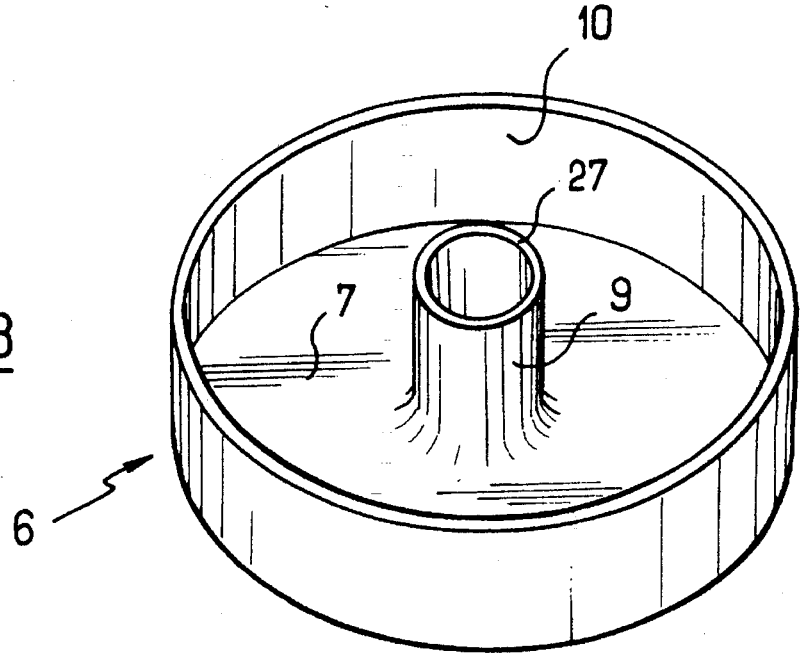

FIGS. 3 and 4 represent an element 6 which is complementary to the preceding element.

This element 6 is composed of a plane axisymmetric part 7 having a circular central orifice 8 bordered by a hollow cylindrical neck 9. The plane part 7 of the element 6 is bordered over its entire periphery by an outer cylindrical wall 10 located on the same side as the neck 9 and having a height substantially equal to that of the neck 9.

The outer diameter of the neck 9 of the element 6 is equal to the inner diameter of the neck 4 of the element 1, whilst the outer diameter of the outer wall 10 of the element 6 is equal to the inner diameter of the outer wall 5 of the element 1. It is thus possible to insert the neck 9 of the element 6 into the neck 4 of the element 1 so that the end 11 of the neck 4 abuts against the inner surface of the plane part 7 of the element 6. Under these conditions, the outer surface of the wall 10 of the element 6 is in contact with the inner surface of the wall 5 of the element 1.

When they have been assembled in this way, the body of the housing 1 and the element 6 which acts as a cover define a cylindrical housing which is closed at each of its ends by a plane face having a central orifice, the two central orifices being connected with continuity by a continuous central channel consisting of the neck 4 of the element 1 into which the neck 9 of the element 6 is fitted. It is in this sense that the two elements 1 and 6 are termed complementary in the context of the present invention.

FIGS. 2, 3 and 4 represent a combustible container obtained from two complementary elements 1 and 6 in which the central neck and the outer wall have substantially the same height. Such housings can be solidly attached to each other with ease, for example by using a ring or an adhesive material.

Figure 5:
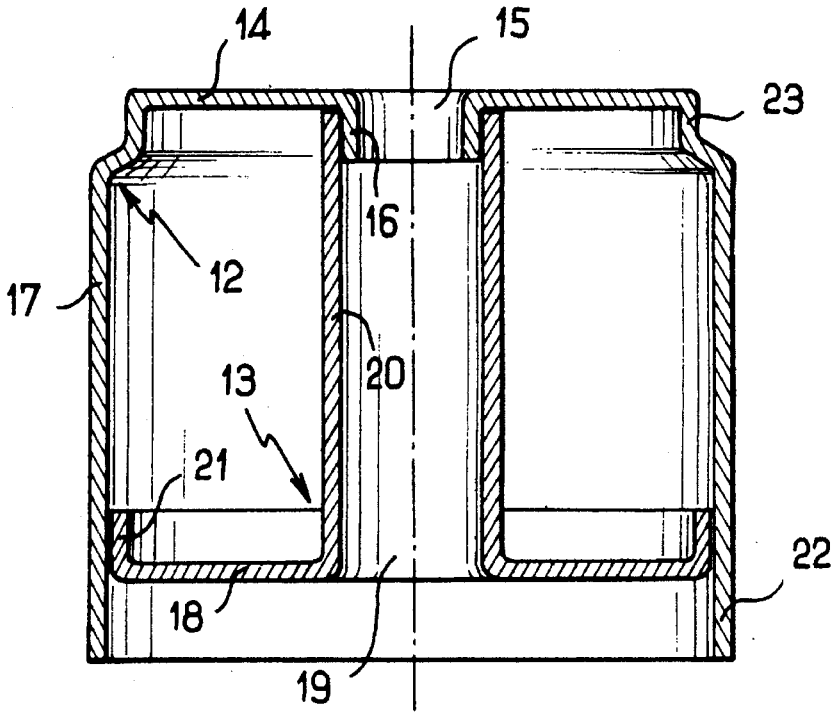
FIG. 5 represents, seen in section, another configuration of two complementary elements according to the invention.
Figure 6:
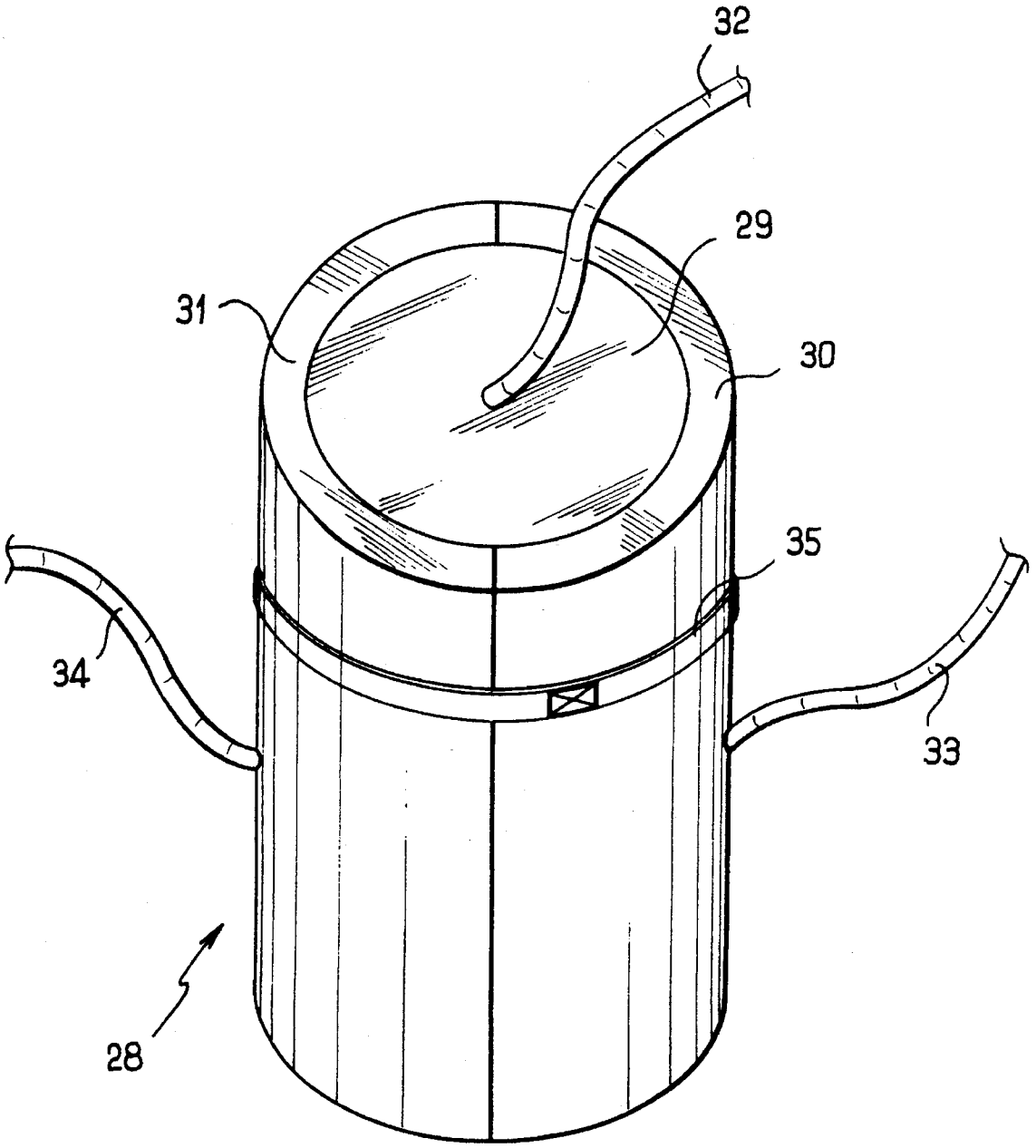
FIG. 6 represents, seen in perspective, a mould for manufacturing an element blank according to the invention by felting.

The invention also relates to combustible container elements in which the outer wall has a different height from the height of the said central neck. FIG. 5 represents, in section, a combustible container housing consisting of two complementary elements 12 and 13.

The element 12 has a plane part 14 having a circular central orifice 15 bordered by a neck 16 with a height very much less than that of the outer wall 17 which borders the plane part 14.

The element 13, on the other hand, has a plane part 18 with a circular central orifice 19 bordered by a neck 20 with height very much greater than that of the outer wall 21 which borders the said plane part 18.

The inner diameter of the neck 20 is equal to the outer diameter of the neck 16, whereas the outer diameter of the wall 21 is equal to the inner diameter of the wall 17, so that the element 13 can engage in the element 12, as represented in FIG. 5.

It will be observed that, in the embodiment represented in FIG. 5, the height of the outer wall 17 of the element 12 is greater than the height of the neck 20 of the element 13, so that the wall 17 extends beyond the plane part 18 of the element 13 when the two elements are assembled together, thus defining a hollow ring 22 beyond the plane part 18.

Furthermore, it will be observed that the outer wall 17 of the element 12 has, on the side of the plane part 14, a recess 23 with a height and an outer diameter such that the housing thus constituted can engage, via its recess, in the ring 22 of the preceding housing.

The combustible container elements according to the invention are obtained, as will be explained in detail in the remainder of the description, by felting on a liquid-permeable mould of an aqueous suspension principally consisting of nitrocellulose fibres, cellulose fibres and of a resin, so as to obtain a blank of the said element which blank is subsequently compacted and stoved. The aqueous suspension may also contain additives making it possible to solve the problems of reducing the erosion or reducing the migration of the nitrated oils. Similarly, the combustible container elements, once finished, may receive various types of coatings or varnishes for protection against external agents. However, it should be emphasized that, characteristically and essentially within the scope of the present invention, the felting of the said blank is carried out in a single operation, so that the said central neck forms an integral part of the said combustible container element. It is noteworthy, in the scope of the present invention, that, for a given element, the plane part, the neck and the outer wall constitute only a single piece with perfect physical continuity.

It is by virtue of this characteristic that assembling two elements which are complementary in the sense of the invention allows simple and easy construction of a combustible container housing having a perfectly positioned and stable central channel.

The invention therefore also relates to the use of the elements according to the invention in a method of production of combustible containers charged with propellant powder for artillery ammunition. This method is characterized in that:

1) in a first step, as will be explained further on in the description, two complementary combustible container elements are manufactured by felting, compacting and stoving.

2) In a second step, one of the said elements is filled with a propellant powder.

3) In a third step, the element thus filled is solidly attached to the second element so as to constitute a combustible container filled with propellant powder and having a central channel.

Figure 1:
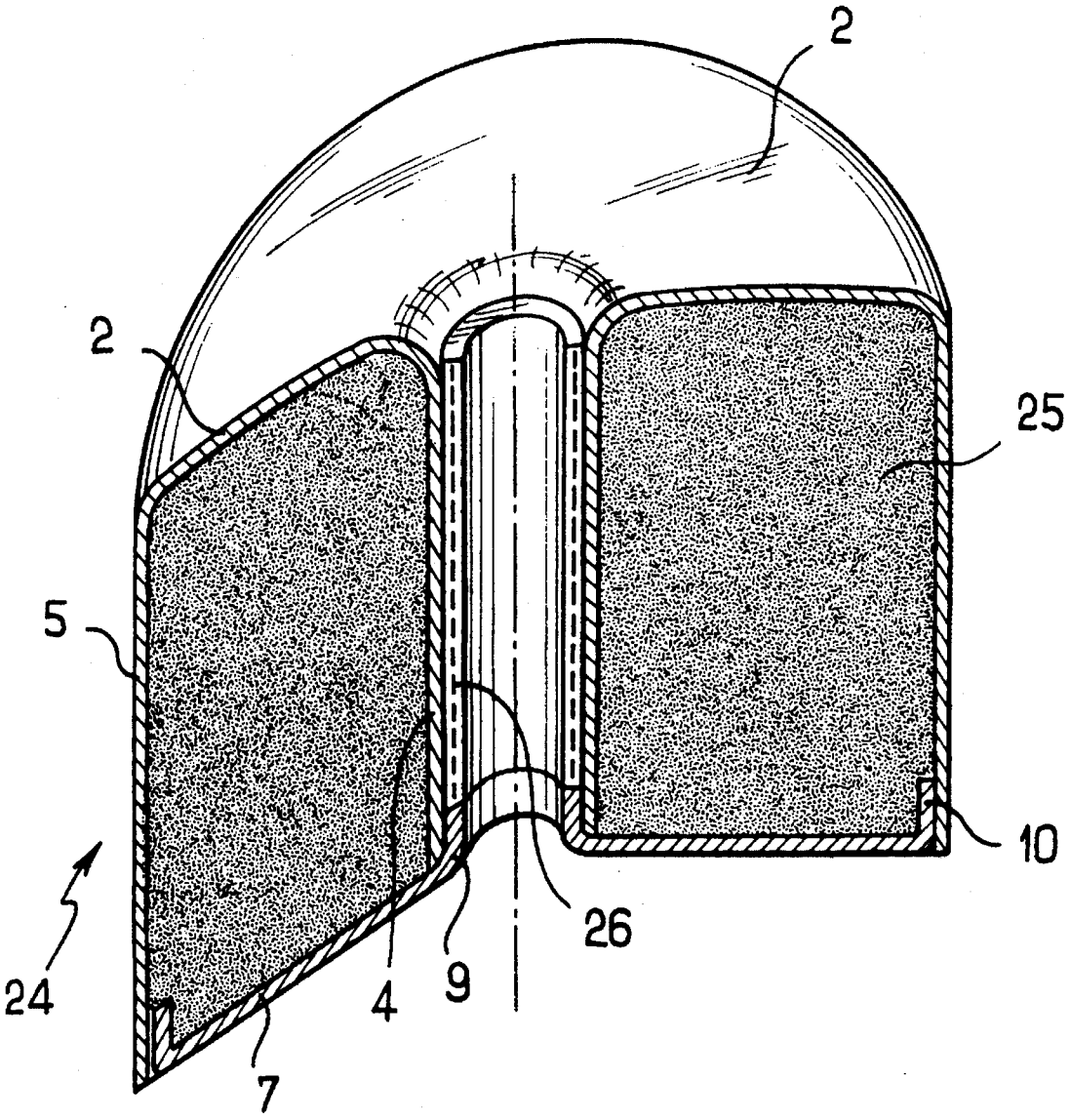
FIG. 1 represents, in partially cut-away view, a modular combustible container according to the invention.

FIG. 1 represents a modular combustible container 24 obtained from the complementary elements 1 and 6 represented in FIGS. 2, 3 and 4. This container 24 was obtained by filling the housing body 1 with a propellant powder 25. The filling of an element according to the invention with a propellant charge consisting of agglomerated powder or of a stick of powder strands bound together poses no particular problem whatever the configuration of the element. On the other hand, when it is desired to carry out filling with strands of powder which are not bound together, as, for example, divided strands as described in FR-A-2,679,992, or alternatively with loose powder grains, the use of a housing body as represented in FIG. 2 proves particularly advantageous. It is in this sense that the complementary elements 1 and 6 represented in FIGS. 2, 3 and 4 are the preferred elements of the invention. When the housing body 1 is filled with powder, and it should be noted that it can be filled completely with ease, the cover 6 is inserted as explained hereinabove. In certain cases, the outer surface of the neck 9 and the outer surface of the wall 10 of the cover 6 will be coated with a small amount of combustible adhesive in order to improve adhesion of the cover to the body of the housing. In other cases, mechanical blocking systems might be preferred.

A modular combustible container is thus obtained which has a central channel essentially defined by the neck 4 of the housing body 1, Before filling, the housing may be pierced at various locations in order to facilitate ignition or combustion.

The presence of a hollow central channel is essential to ensure correct transmission of the ignition from one module to the next. In order further to improve the ignition, a complementary hollow ignition tube 26 is introduced into the central channel thus constituted.

In the embodiment represented in FIG. 1, this complementary combustible ignition tube 26 bears on the upper end 27 of the neck 9 of the cover 6 and is held in contact with the inner surface of the neck 4 of the housing body 1 by a small amount of combustible adhesive. The complementary ignition tube 26 may consist of a sole piece or several segments placed end to end.

According to a preferred embodiment of the invention, the ignition tube 26 is obtained by agglomeration under pressure and at a temperature close to 100° C. of grains of propellant powder coated by a binder based on polyvinyl nitrate according to the techniques described in French Patents 2,436,766 and 2,658,505 or in their U.S. Pat. Nos. counterparts 4,326,901 and 5,174,837. A combustible-paper reinforcing tube may also be introduced into the ignition tube 26. The said propellant powder used to constitute the tube 26 may advantageously be a powder based on porous or non-porous nitrocellulose, optionally containing additives. The invention thus makes it possible to do without any presence of black powder, which reduces the risks of corrosion. The tube 26 may also be obtained by agglomerating ignition powders for composite powders with low vulnerability.

The invention also relates to a method of manufacture by felting of combustible container elements according to the invention and, in particular, elements as represented in FIG. 2 which have both a long neck and a long outer wall. The traditional felting techniques according to which the solid deposition is carried out on the outer surface of a mould immersed in a suspension do not actually make it possible to obtain cylindrical hollow pieces having at their centre a long central neck which is itself hollow, suction in the central cavity of the mould corresponding to the said neck making it possible only to obtain a solid neck, which is not what is desired in the context of the invention.

In order to obtain, by felting, an element blank according to the invention, a mould is immersed in the felting suspension, which mould has an axisymmetric cavity consisting of an outer casing and of a bottom whose surface is plane, said bottom having a central column. At least the said bottom and the said column are liquid-permeable and suction is exerted on the inside of the mould.

The felting suspension is preferably an aqueous suspension principally consisting of nitrocellulose fibres, cellulose fibres and of a resin, optionally in the presence of a stabilizer such as diphenylamine. Such a suspension is, for example, described in patent FR 2,555,302 or in its U.S. Pat. No. counterpart 4,649,827.

FIGS. 6 to 10 represent a mould 28 according to the invention.

The mould 28 is composed of a central part 29 and an outer part consisting of two semicylindrical shells 30 and 31. The central part 29 is connected by a hose 32 to a vacuum pump, whereas the outer shells 30 and 31 are connected to a vacuum pump by hoses 33 and 34. A clamping hoop 35 holds the shells 30 and 31 tightly against each other.

Figure 7:
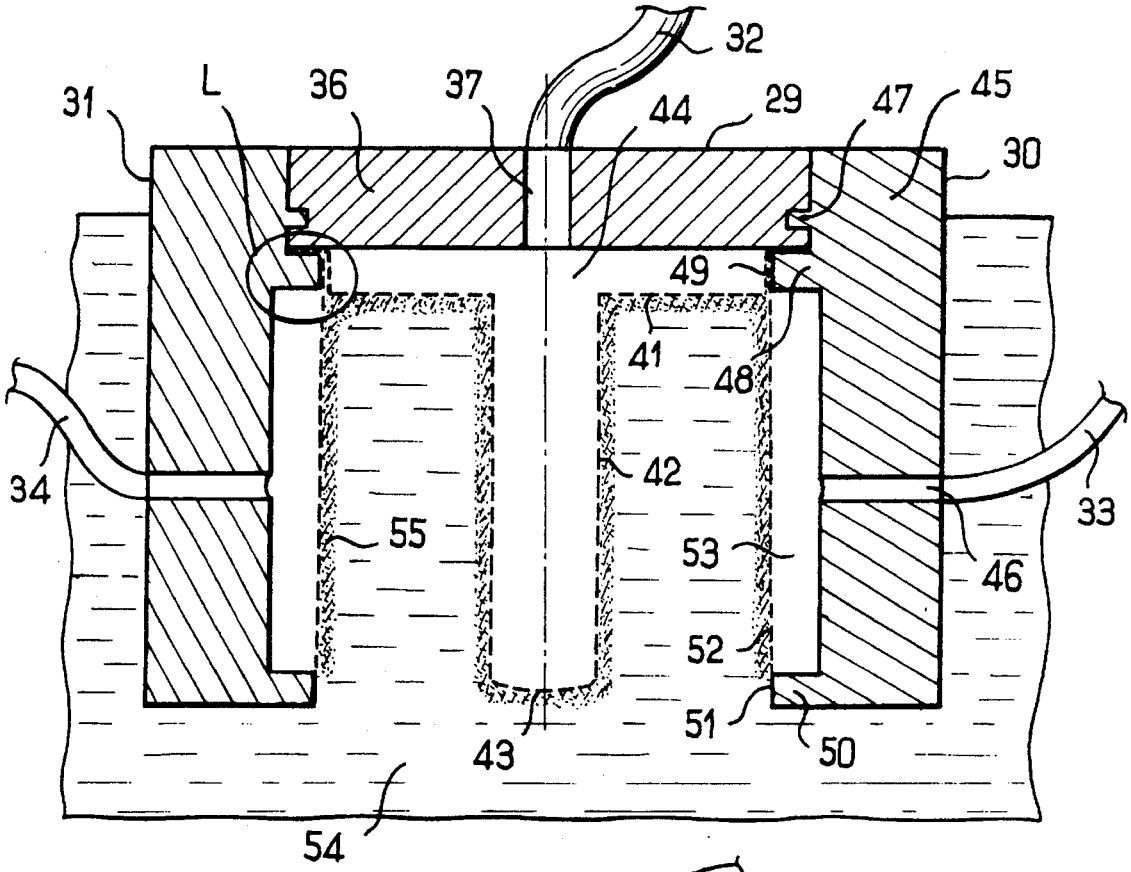
FIG. 7 represents, seen in section, the mould in FIG. 6 when immersed in the felting suspension.
Figure 8:
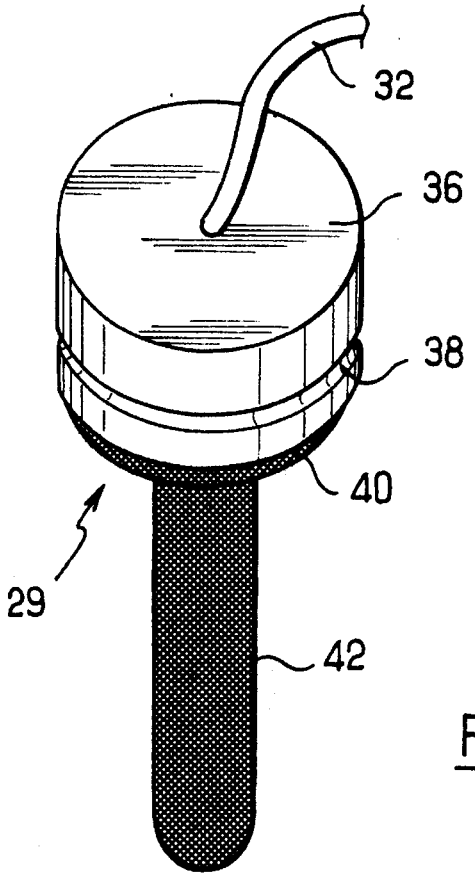
FIG. 8 represents, seen in perspective, the central part of the mould represented in FIGS. 6 and 7.
Figure 10:
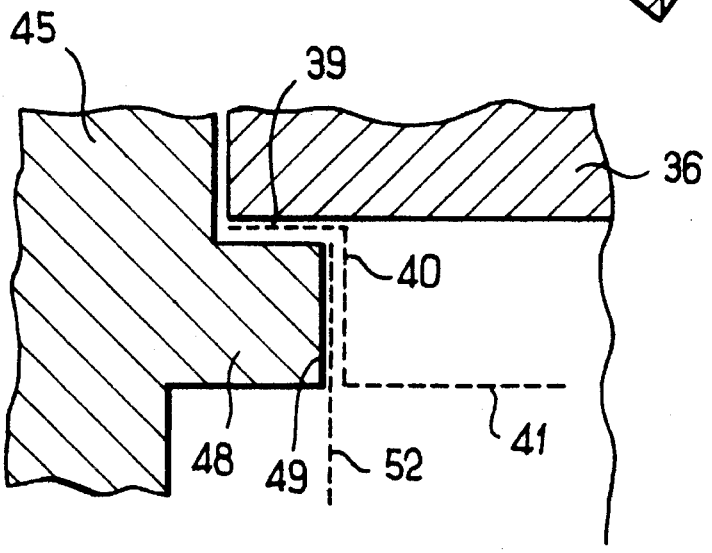
FIG. 10 is a magnification of the part L in FIG. 7.

Referring more particularly to FIGS. 7, 8 and 10, it is seen that the central part 29 is composed of a cylindrical head 36 through which a hollow duct 37 connected to the hose 32 passes. The head 36 has a circular groove 38 on its cylindrical face. A liquid-permeable filtering screen is fixed by welding on the lower plane face of the head 36, which screen has a flat circular rim 39 welded to the head 36, a first vertical cylindrical surface 40, an annular plane face 41 terminated in its central part by a cylindrical column 42 closed by a bottom 43, thus making an empty space 44 between the head 36 and the filtering screen.

The filtering screen constituting the elements 39, 40, 41, 42 and 43 advantageously consists of a perforated copper screen which is covered by an electro-formed nickel filter.

Figure 9:
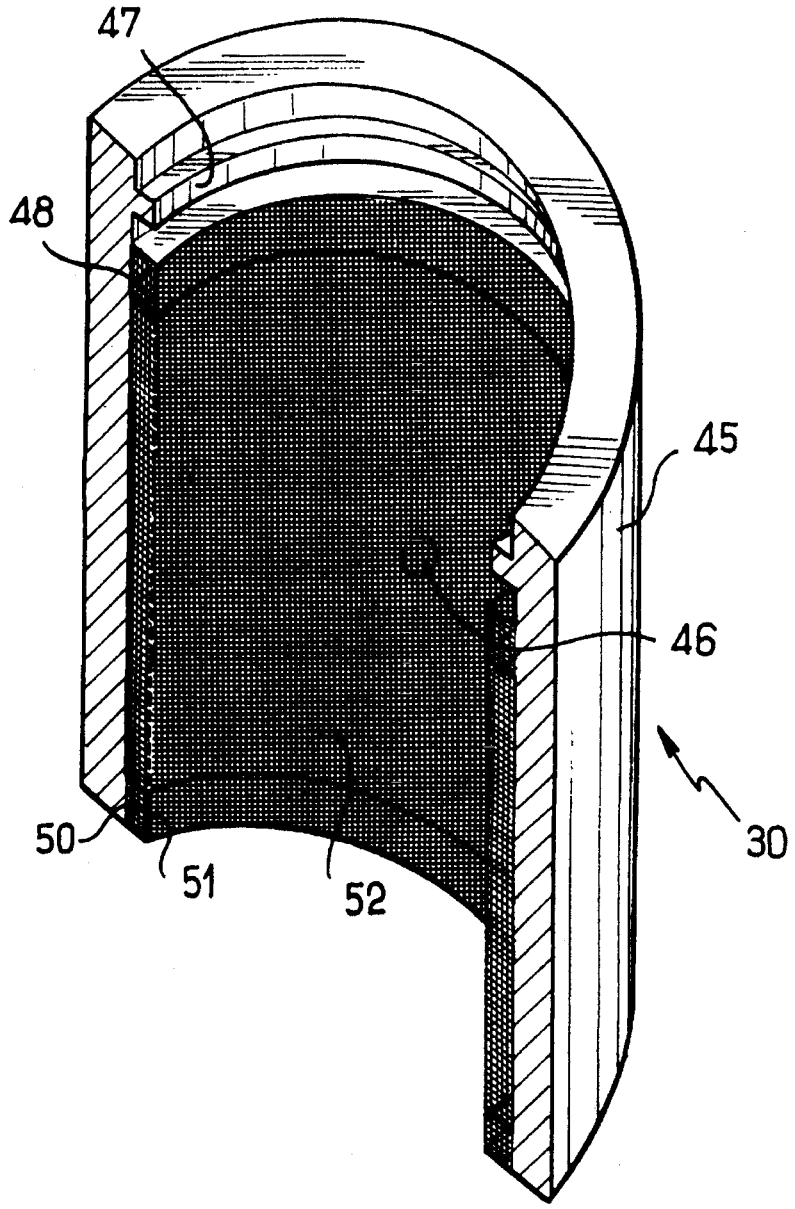
FIG. 9 represents, seen in perspective, one of the two outer shells of the mould represented in FIGS. 6 and 7.

Now referring more particularly to FIGS. 7, 9 and 10, it is seen that the shell 30 is composed of a solid semicylindrical wall 45 through which a hollow duct 46 connected to the hose 33 passes. The inner surface of the wall 45 has a rim 47 intended to penetrate into the groove 38 of the head 36 in order to position the shell 30 with respect to the head 36. Below the rim 47, the inner surface of the wall 45 has a flap 48 having a vertical surface 49 and intended to slide under the head 36, the vertical surface 49 of the flap being equal in height to the vertical surface 40 of the screen carried by the head 36 and abutting against the latter. At the base of the inner surface of the wall 45, there is a second flap 50 having a vertical surface 51, the radial depth of the flap 50 being identical to that of the flap 48, so that the vertical surfaces 49 and 51 correspond to one and the same vertical cylinder. On the vertical surfaces 49 and 51 is fixed a semicylindrical filtering screen 52 of the same construction as the filtering screen carried by the head 36. An empty space 53 is thus made between the wall 45 and the screen 52.

The shell 31 is similar to the shell 30.

When they are fixed to the head 36, the shells 30 and 31 define with the latter a cylindrical mould 28 having an axisymmetric cavity consisting of a casing composed of the screens 52, the two shells 30 and 31, of a plane bottom itself consisting of the plane face 41 of the screen carried by the head 36 and of a column itself consisting of parts 42 and 43 of the screen carried by the head 36.

The mould represented in FIGS. 7 to 10 is intended to obtain an article as represented in FIG. 2, the casing consisting of the screens 52 being, in this case, liquid-permeable. In order to obtain other configurations, this casing might be only partially liquid-permeable.

In the case represented in FIGS. 7 to 10, the length of the screen 52 contained between the flaps 48 and 50 as well as the length of the part 42 of the screen carried by the head 36 will be slightly greater than the final dimensions of the element which it is desired to obtain.

By immersing the mould in a suspension 54 as previously defined and by evacuating the spaces 44 and 53, deposition of a blank 55 along the filtering screen is caused. This blank has the general shape of the element 1 represented in FIG. 2, but its hollow neck 4 is closed by the deposition of fibres on the surface 43 of the filtering screen carried by the head 36.

When the formation of the blank is completed, the mould is withdrawn from the aqueous suspension and the blank 55 undergoes a first vacuum drying on the mould. The shells 30 and 31 are then removed and the blank 55 is withdrawn from the mould to be compacted and stoved on a forming mould, according to techniques known to the person skilled in the art. After stoving, the element is cut to the desired length, which has the effect of opening the central neck which was hitherto closed.

The elements according to the invention thus make it possible simply to obtain modular combustible containers for artillery ammunition of medium and large calibre which can be completely and easily charged with the various geometries of propellant powders existing on the market.

An example of implementation of the invention is given hereinbelow.

EXAMPLE

A combustible housing body and a cover according to FIGS. 2 and 3 are manufactured.

The composition of the felting suspension was as follows:

| | |
|---|---|
| nitrocellulose | 65.8% by weight |
| cellulose | 25.6% by weight |
| acrylic resin | 7.6% by weight |
| diphenylamine | 1.0% by weight |
| water | sufficient quantity for a 2.5% aqueous suspension |

The dimensions of the articles were as follows:

| | | |
|---|---|---|
| housing body: | length | 154 mm |
| | outer diameter | 158 mm |
| | inner diameter | 153 mm |
| hollow neck | length | 151.5 mm |
| | outer diameter | 30 mm |
| | inner diameter | 25 mm |
| cover: | height of the outer wall | 15 mm |
| | outer diameter | 15 mm |
| | inner diameter | 148 mm |
| hollow neck | length | 15 mm |
| | outer diameter | 25 mm |
| | inner diameter | 20 mm |

Sufficient reproducibility was obtained on a batch of 50 articles, namely: 5% on the mass standard deviation, less than 2% on the thickness standard deviation and less than 1% on the volume standard deviation.

The housing body was filled with 2450 g of a double-based powder (nitrocellulose/nitroglycerine) in the form of cylindrical grains with 19 holes having potential 900 cal/g i.e. 3780 J/g (or 2700 g of this same powder in form of divided strands).

An ignition tube was introduced into the central channel of the container thus constituted, which tube was obtained from a porous single-based nitrocellulose powder coated with 3% of binder or polyvinyl nitrate.

This tube has an apparent density of 0.77 g/cm$^3$.

It consists of two identical cylindrical segments of length 76 mm, outer diameter 25 mm, inner diameter 15.4 mm.

Each section was obtained from 18 g of coated porous powder.

These segments were placed in a manometric bomb of volume 156 $cm^3$ and with a charging density of 0.10.

The results of bomb firing were as follows:

force: 1 MJ/kg, ignition time: 3.6 milliseconds, combustion time: 2.1 milliseconds.

A combustible container as described hereinabove, charged with the powder in grains with 19 holes, was introduced into a firing simulator of volume 3745 $cm^3$.

The firing results were as follows:

| | |
|---|---|
| charging density | 0.687 |
| maximum pressure reached on rupture of the capsule | 60 MPa |
| average pressure increase (ms = millisecond) | $6 \times 10^{-3}$ MPa/ms |
| ignition delay | 78 ms |
| combustion time | 3.2 ms. |

I claim:

1. A pair of combustible container elements for artillery ammunition, each of said combustible container elements being obtained by felting on a liquid-permeable mold an aqueous suspension principally consisting of nitrocellulose fibers, cellulose fibers and a resin, whereby a blank is obtained which is subsequently compacted and stoved, wherein:

i) each of said elements has at least one substantially plane axisymmetric part, said plane axisymmetric part having a central orifice, said orifice being bordered by a hollow central cylindrical neck;

ii) each of said plane axisymmetric parts is bordered by a cylindrical outer wall, said cylindrical outer wall being located on the same side as the said hollow central cylindrical neck;

iii) said elements define, when being assembled one with the other, a cylindrical housing which is closed at each of its ends by a plane face having a central orifice, the two central orifices being connected with continuity by a central channel consisting of said necks of said two elements;

iv) the felting of each of the said blanks is carried out in one single operation.

2. The pair of combustible container elements according to claim 1, wherein each of said elements has an outer wall, said central neck has a height, said outer wall has a height substantially equal to said height of said central neck.

3. The pair of combustible container elements according to claim 1, wherein each of said elements has an outer wall, said central neck has a height, said outer wall has a height different from the height of said central neck.

* * * * *